US005499590A

United States Patent [19]

Kamewada et al.

[11] Patent Number: 5,499,590

[45] Date of Patent: Mar. 19, 1996

[54] THREAD GUIDE HOLDER DEVICE FOR SEWING MACHINE

[75] Inventors: Makoto Kamewada; Shinji Kojima, both of Utsunomiya, Japan

[73] Assignee: The Singer Company N.V., Curaco, Netherlands Antilles

[21] Appl. No.: 336,585

[22] Filed: Nov. 9, 1994

[30] Foreign Application Priority Data

Nov. 17, 1993 [JP] Japan ..... 5-065868

[51] Int. Cl.[6] ..... D05B 53/00

[52] U.S. Cl. ..... 112/302; 242/157 R; 139/450

[58] Field of Search ..... 112/302, 258, 112/270; 242/157 R, 157.1, 128; 223/106; 139/450

[56] References Cited

U.S. PATENT DOCUMENTS 1,452,033 4/1923 Fifield ..... 112/302

2,357,716 9/1944 Ballamy et al. ..... 112/302

2,688,294 9/1954 McCloud ..... 112/302

*Primary Examiner*—Peter Nerbun

*Attorney, Agent, or Firm*—McCormick, Paulding & Huber

[57] ABSTRACT

A thread guide holder device comprises a thread guide holder which is mounted on a spool stand base and has thread guides each for guiding a thread therethrough, wherein the thread guide holder is mounted on the spool stand base by way of damping materials. As a result, it is possible to restrain the oscillation of the thread guide holder during sewing operation so as to smoothly draw out the threads through the thread guides of the thread guide holder and consequently prevent irregular stitches and restrain an eye-offensive oscillation of the thread guide holder.

1 Claim, 1 Drawing Sheet

THREAD GUIDE HOLDER DEVICE FOR SEWING MACHINE

BACKGROUND OF THE INVENTION

1. Field of the Invention

The present invention relates to a thread guide holder device for a sewing machine.

2. Prior Art

There is known a conventional thread guide holder device for a sewing machine equipped with a thread guide holder which has thread guides each for guiding a sewing thread therethrough and is mounted on a spool stand base. In such a conventional thread guide holder device, however, a thread guide holder is in solid-state contact with the spool stand base, so that vibration accompanying the operation of the sewing machine is directly transmitted to the thread guide holder to cause a comparatively large oscillation thereof and also the consequent oscillation of threads guided by the thread guides thereof, resulting in a technical problem that the thread guide holder applies repeated tension and relaxation to threads fed through the thread guides thereof, causing irregular stitches. It causes large disorder particularly in a sewing machine which performs zigzag sewing such as that for overedge chain stitch.

SUMMARY OF THE INVENTION

The present invention has been made in view of the aforesaid technical problem in the prior art to provide a thread guide holder device comprising a thread guide holder 4 which is mounted on a spool stand base 3 and has thread guides 4*e* each for guiding a thread 8 therethrough, characterized in that the thread guide holder 4 is mounted on the spool stand base 3 by way of damping materials 5 and 6.

Sewing operation is performed with the threads 8 passing through the thread guides 4*e* in such a thread guide holder device. The oscillation of the spool stand base 3 accompanying the operation of a sewing machine is absorbed by the damping materials 5 and 6 to effectively restrain the oscillation of the thread guide holder 4. Moreover, the oscillation of the threads 8 which are guided by thread guides 4*e* of the thread guide holder 4 is also prevented effectively. As a result, irregular stitches caused by the oscillation of the threads 8 is eliminated particularly in an overedge machine.

PREFERRED EMBODIMENT OF THE INVENTION

An embodiment of the present invention will be described hereinafter.

Figure 1:
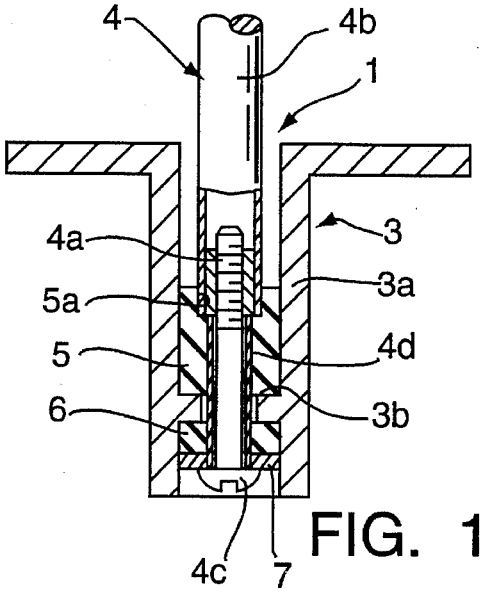
FIG. 1 is a partially-omitted cross-sectional view of a thread guide holder device according to the present invention.
Figure 2:
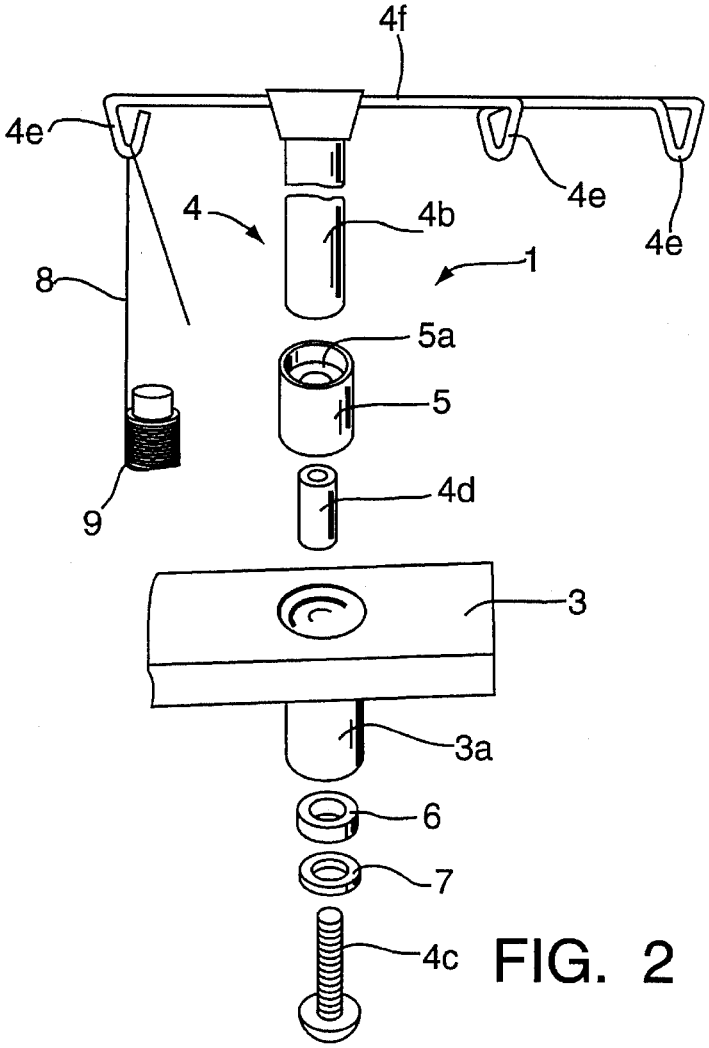
FIG. 2 is an exploded perspective view showing an essential part of the thread guide holder device in FIG. 1.

FIGS. 1 and 2 show a thread guide holder device for a sewing machine according to an embodiment of the present invention. In the figures, denoted at I is the thread guide holder device, which is provided in a well-known sewing machine body, more in concrete, on the arm thereof. A spool stand base 3 is formed at the rear side of the arm integrally therewith. The spool stand base 3 comprises a cylindrical portion 3*a* which projects downward and has an inner flange portion 3*b* adjacent to the lower end portion thereof.

The thread guide holder 4 having a cylindrical shape comprises a thread guide holder body 4*b* into the lower end portion of which a plug 4*a* having an internally threaded hole therein is fixed, a screw 4*c* which is screwed into the plug 4*a* and a cylindrical spacer 4*d* which intervenes between the lower surface of the plug 4*a* and the head portion of the screw 4*c*. Moreover, a horizontally extending thread guiding portion 4*f* is fixed to the upper end portion of the thread guide holder body 4*b* and thread guides 4*e* are formed in the thread guiding portion 4*f*. The thread guiding portion 4*f* which is formed by bending a metal bar comprises three thread guides 4*e* therein since it is designed for an overedge machine. Virtually, the thread guide holder body 4*b* is telescopic and the thread guides 4*e* thereof are positioned above the arm in use.

Damping materials 5 and 6 such as rubber or elastomer are arranged inside the spool stand base 3 on the upper and lower side surfaces of the inner flange portion 3*b* thereof. The damping material 5 which is arranged on the upper side surface of the inner flange portion 3*b* has a shape of cylinder having an annular recess 5*a* at the upper end portion thereof for receiving the lower end portion of the thread guide holder body 4*b* therein. The damping material 6 which is arranged on the lower side surface of the inner flange portion 3*b* has an annular shape.

In assembling such a thread guide holder device 1, the damping materials 5 and 6 are disposed inside the spool stand base 3 on the upper and lower side surfaces of the inner flange portion 3*b* thereof respectively and the thread guide holder body 4*b* is inserted into the cylindrical portion 3*a* from above until the lower end portion of the thread guide holder body 4*b* is fit in the annular recess 5*a* of the damping material 5. On the other hand, the screw 4*c* passing through a washer 7 and the spacer 4*d* is inserted into the cylindrical portion 3*a* from below to be screwed into the plug 4*a* through the lower damping material 6, inner flange portion 3*b* and the upper damping material 5. At this state, the spacer 4*d* is not in contact with the inner flange portion 3*b*. Since the screwed amount of the screw 4*c* into the plug 4*a* is restrained by the spacer 4*d*, the damping materials 5 and 6 are prevented from being so excessively compressed as to reduce the damping performance, being in proper contact with the inner circumference of the cylindrical portion 3*a* at the outer circumference thereof to hold the thread guide holder 4. Thus the thread guide holder device 1 is assembled to mount the thread guide holder 4 on the spool stand base 3 by way of the damping materials 5 and 6.

In such a thread guide holder device 1, sewing operation is performed with threads 8 which are fed from spools 9 each rotatably supported by a spool pin, not shown, mounted on the spool stand base 3 and are guided by the thread guides 4*e*. Although vibration is generated in the arm and spool stand base 3 at the time of operation of the sewing machine, it is absorbed by the damping materials 5 and 6 which are respectively arranged on the upper and lower side surfaces of the inner flange portion 3*b* so that the vibration of the spool stand base 3 is not transmitted to the thread guide holder 4 to effectively restrain the oscillation of the thread guide holder body 4*b*. Accordingly, the threads 8 passing through the thread guides 4*e* are effectively restrained from oscillating. As a result, the irregular stitches caused by the oscillation of the threads 8 is eliminated particularly in the overedge machine.

Although the damping materials 5 and 6 are respectively arranged on the upper and lower side surfaces of the inner flange portion 3*b* of the spool stand base 3 to position the thread guide holder body 4*b* upright in the above embodiment, almost similar effect can be obtained with regard to absorbing vibration to prevent irregular stitches by arranging the damping material 5 or 6 on either of the upper and lower side surfaces of the inner flange portion 3*b*. Furthermore, although rubber or elastomer is used for the damping materials 5 and 6 in the above embodiment, it is also possible to use a spring or other damping materials singly or in combination.

As understood from the above description, since the thread guide holder device according to the present invention can restrain the oscillation of the thread guide holder during sewing operation to smoothly draw out the threads through the thread guides of the thread guide holder, irregular stitches can be prevented. Moreover, it is possible to restrain an eye-offensive oscillation of the thread guide holder for improving sewing operability.

What is claimed is:

1. A thread guide holder device comprising a thread guide holder mounted on a spool stand base and having thread guides for guiding threads therethrough, said thread guide holder including a thread guide holder body received within said spool stand base, wherein said thread guide holding device further comprises damping material disposed between said spool stand base and said thread guide holder body.

* * * * *